428-911 SR
12/17/85 XR 4,559,251

United States Patent [19]
Wachi

[11] Patent Number: 4,559,251
[45] Date of Patent: Dec. 17, 1985

[54] MATERIAL FOR ACCIDENT PROTECTING CLOTHES WITH CONNECTED TILE-LIKE SMALL NYLON PLATES

[76] Inventor: Kaoru Wachi, 1-13-4, Kamifukuoka, Kamifukuoka-shi, Saitama-ken, Japan

[21] Appl. No.: 701,374

[22] Filed: Feb. 14, 1985

[30] Foreign Application Priority Data

Feb. 17, 1984 [JP] Japan ..... 59-21418[U]
Oct. 9, 1984 [JP] Japan ..... 59-152948[U]

[51] Int. Cl.[4] ..... F41H 1/02
[52] U.S. Cl. ..... 428/53; 428/33; 428/76; 428/252; 428/287; 428/492; 428/911
[58] Field of Search ..... 428/33, 53, 76, 252, 428/287, 492, 911

[56] References Cited

U.S. PATENT DOCUMENTS 2,372,520 3/1945 Rubin ..... 428/33
4,200,677 4/1980 Bottini ..... 428/911

*Primary Examiner*—Marion E. McCamish
*Attorney, Agent, or Firm*—Ostrolenk, Faber, Gerb & Soffen

[57] ABSTRACT

The present invention provides a material for accident protecting clothes in which tile-like small plate pieces made of nylon series resin are connected and formed, beneath a layer of bulletproof fiber sheets stacked in number as required, into a flexible plate-like configuration by connectors, soft rubber is placed beneath the flexible plate, a few sheets of bulletproof fiber sheets are attached beneath the soft rubber, and the whole structure is integrally coated with a water-resisting synthetic resin sheet.

2 Claims, 14 Drawing Figures

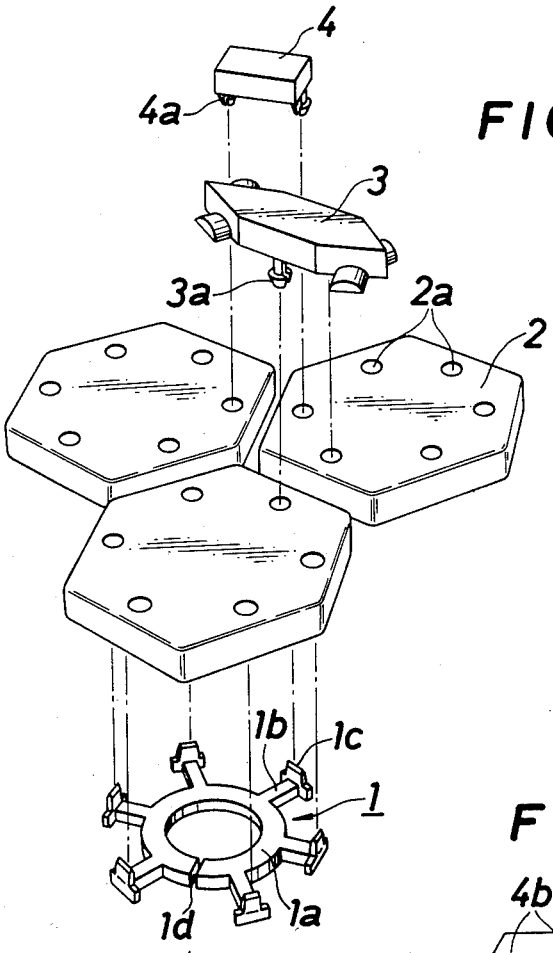
FIG. 9
FIG. 10
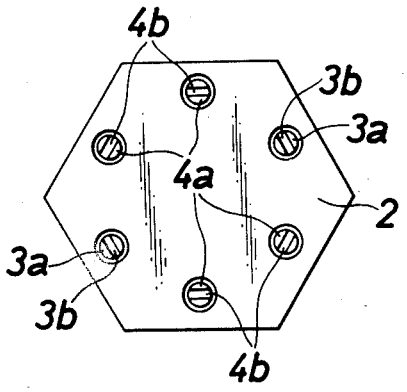

MATERIAL FOR ACCIDENT PROTECTING CLOTHES WITH CONNECTED TILE-LIKE SMALL NYLON PLATES

BACKGROUND OF THE INVENTION (1) Field of the Invention

This invention relates to materials for accident protecting clothes.

(2) Description of the Prior Art

A variety of accident protecting clothes such as fireproof clothes have been heretofore proposed in accordance with an object of use. However, if sharp objects such as high-speed flying objects, pieces of broken glass and edged tools resulting from explosions or the like are stuck into human bodies, prior art accident protecting clothes are not sufficient to protect the bodies. That is, even if the sharp object should be stuck for example at a low speed, it is often that the protecting clothes are broken or holes are made therein to reach the human body to kill and wound the latter. In addition, in case of high-speed flying objects, even if one can check the arrival thereof at the human body, violent shocks are applied and therefore troubles such as death or serious illness due to the internal rupture occur.

To cope with these prior art problems, the body can be defended with protecting clothes formed of material enough to withstand sticking by the sharp objects and shocks resulting from the high-speed flying objects. Actually, however, the protecting clothes become so heavy that they cannot be used, and the protecting clothes are not always durable against fire or the like.

SUMMARY OF THE INVENTION

An object of the present invention is to provide ideal materials for accident protecting clothes which overcome prior art problems noted above. An inventive feature of the invention lies in a material for accident protecting clothes wherein tile-like small plate pieces made of nylon series resin are connected and formed, beneath a layer of bulletproof fiber sheets stacked in number as required, into a flexible plate-like configuration by connectors, soft rubber is placed beneath the flexible plate, a few sheets of bulletproof fiber sheets are attached beneath the soft rubber, and the whole structure is integrally coated with a water-resisting synthetic resin sheet.

BRIEF DESCRIPTION OF THE INVENTION

Figure 6:
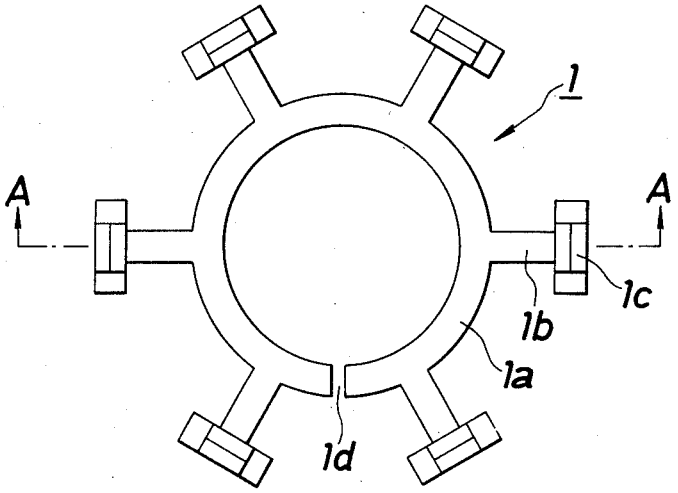
Figure 7:
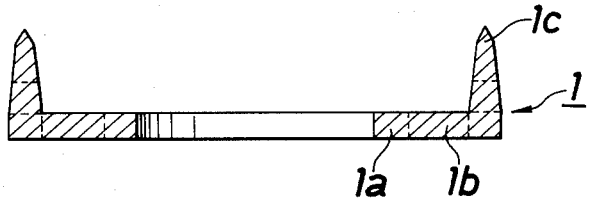
Figure 8:
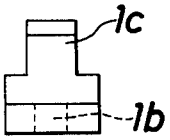
Figure 11:
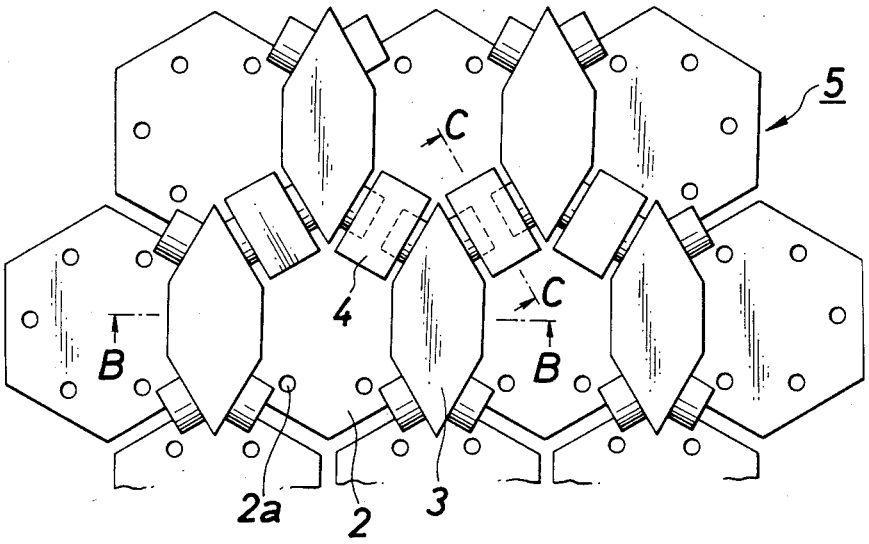
Figure 12:
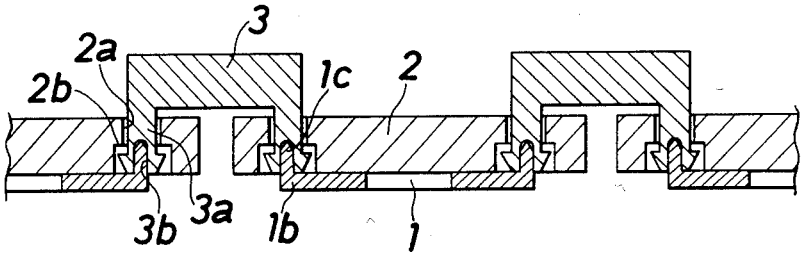
Figure 13:
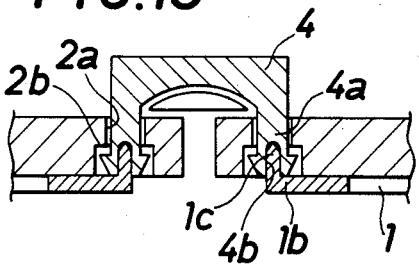
Figure 14:
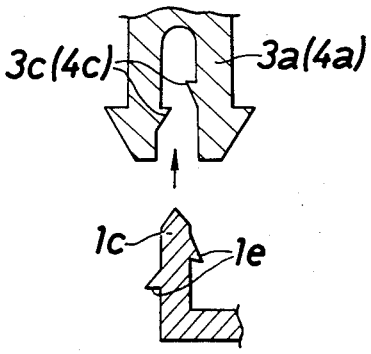

FIGS. 6 to 13 are views showing other embodiments; FIG. 6 is a plan view of a wedge in accordance with the present invention, FIG. 7 is a sectional view taken on line A—A of FIG. 6, FIG. 8 is a side view of a wedge piece of the wedge, FIG. 9 is a perspective view showing the procedure of assembling plate-like members, FIG. 10 is a rear view of a tile-like small plate, FIG. 11 is a plan view of a part of the plate-like member, FIG. 12 is a sectional view taken on line B—B of FIG. 11, and FIG. 13 is a sectional view taken on line C—C of FIG. 11; and FIG. 14 is a sectional view of an essential portion in another embodiment.

DETAILED DESCRIPTION OF THE INVENTION

Figure 1:
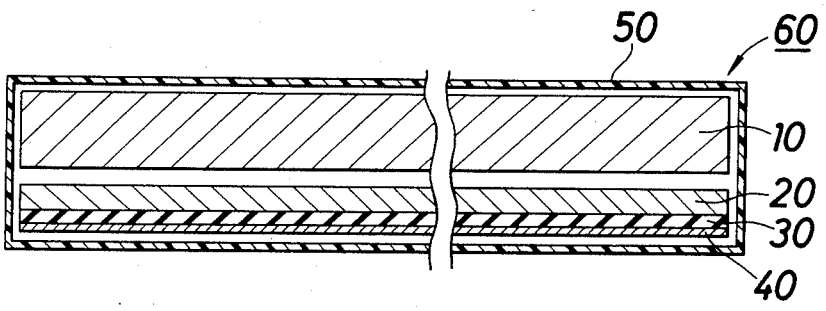
FIG. 1 is a sectional view showing a construction of layers of materials for accident protecting clothes.

The present invention will now be described specifically by way of embodiments shown in the drawings. FIG. 1 shows a layer of materials for accident protecting clothes in accordance with the present invention. A reference numeral 10 designates a layer of bulletproof fiber sheets in which two cloth sheets woven by bulletproof fibers are applied together, and about ten sheets of these applied clothes are placed one over another to form a layer of about 10 m/m. The bulletproof fiber sheet is normally used for a material for a bulletproof jacket and is noninflammable which is durable against even fire but has a disadvantage in that the material is easily torn by an edged tool or the like and somewhat lowered in tensile strength when getting wet with water. A reference numeral 20 in FIGS. 2 and 3 designates an edge-proof and shock-dispersing material applied beneath the bulletproof fiber sheet layer 10, which comprises a tile-like small plate piece 21 and first and second connectors 22, 23 connecting the piece 21, which are formed into a flexible plate configuration. The small plate piece 21 is formed into a regular hexagon with 66 nylon series resin, a hole 21*a* with a shoulder is provided somewhat internally from the middle portion of each side, and there is further internally formed with a regular hexagonal small projection 21*b* outer periphery of which is parallel to each side. The first connector 22 is formed of a hard synthetic resin, a pin 22*a* is projected in the central portion of both ends, a resilient engaging pawl 22*b* applied with a cut is formed in the lower end of the pin, an upper surface of the connector is formed into a roof-like configuration of a tent, front end and rear end are forked which are respectively formed with a semicylindrical projection 22*c*. The second connector 23 is likewise formed of a hard synthetic resin, a pin 23*a* is extended, similarly to the first connector 22, in the central portion of both ends, a resilient engaging pawl 23*b* is formed in the lower end thereof, an upper surface thereof is formed into a roof-like configuration of a tent, and the end is coated on the projection 22*c*.

Figure 2:
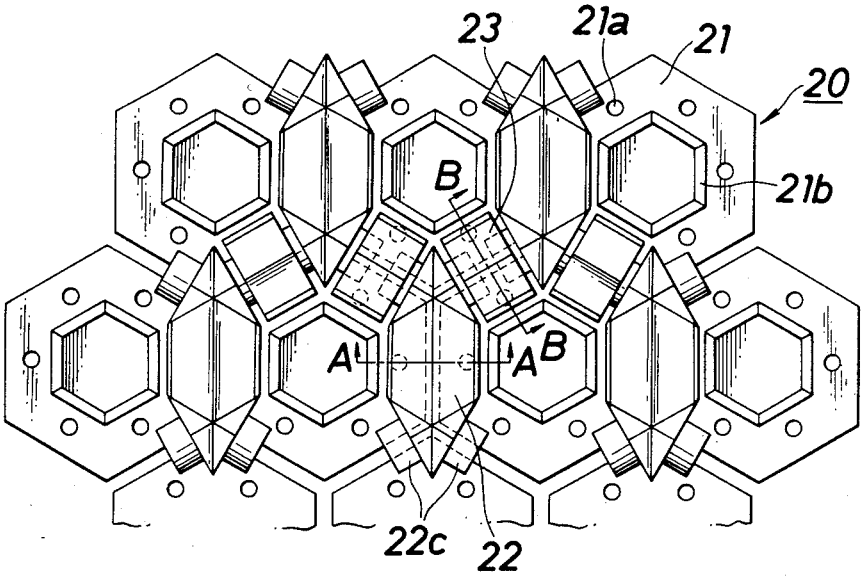
FIG. 2 is a plan view showing a part of an edge-proof and shock-dispersing material.
Figure 3:
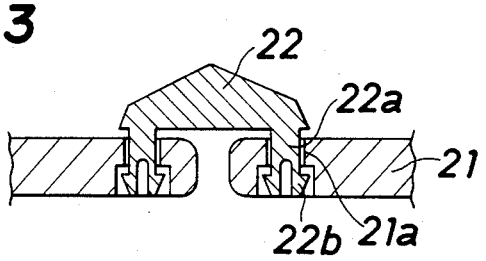
FIG. 3 is a sectional view taken on line A—A of FIG. 2.
Figure 4:
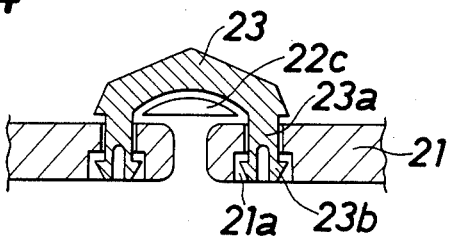
FIG. 4 is a sectional view taken on line B—B of FIG. 2.
Figure 5:
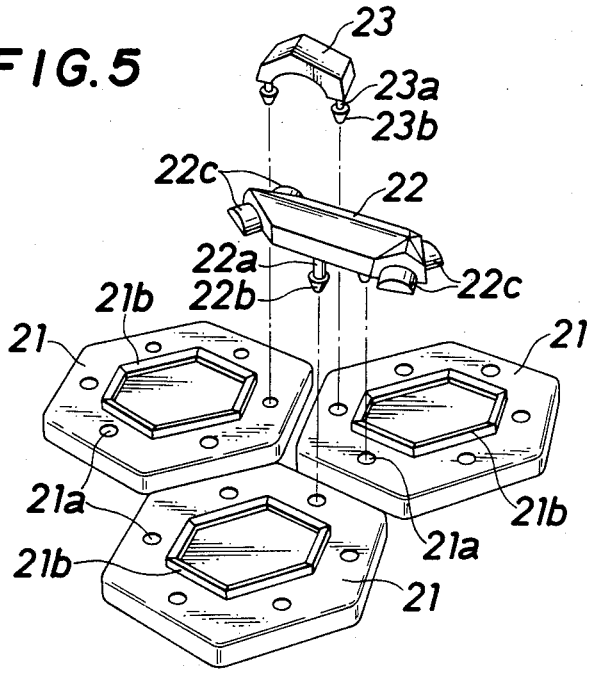
FIG. 5 is a perspective view for explanation of connecting procedure of the edge-proof and shock-dispersing material.

To form the aforesaid edge-proof and shock dispersing member 20 by using the small plate pieces 21 and the first and second connectors 22, 23, the small plate pieces 21 are arranged adjacent to each other so that their sides are opposed, the resilient engaging pawl 22*b* of the first connector 22 is inserted into and engaged at the hole 21*a* of the small plate piece 21, and the left and right small plate pieces 21 are first connected, as shown in FIG. 5. Then, the resilient engaging pawl 23*b* of the second connector 23 is inserted into and engaged at the small plate pieces 21 obliquely adjacent to each other, and at this time, the end of the second connector 23 is placed on the projection 22*c* of the first connector 22. In this manner, the small plate pieces 21 may be successively connected to thereby easily form an edge-proof and shock dispersing member 20 as shown in FIG. 2.

In this edge-proof and shock dispersing member 20, a slight spacing is maintained between the opposed sides of the adjacent small plate pieces 21 and the pins 22*a* and 23*a* of the first and second connectors 22, 23 are in a loosely fitted state with respect to the hole 21*a* of the small plate piece 21, thus providing a flexible construction so that they may be moved each other even after being connected. In addition, the connectors 22 and 23 are positioned while extending the opposed sides of the small plate pieces 21, and therefore, clearances between the small plate pieces 21 assume the state wherein they are all blocked from the front side.

A reference numeral 30 designates shock absorbing soft rubber having a thickness of approx. 3 mm placed beneath the edge-proof and shock dispersing member 20. A reference numeral 40 designates a bulletproof fiber sheet applied beneath the soft rubber 30, a few sheets (two in the illustrated embodiment) being placed one over the other. A reference numeral 50 designates a waterproof soft synthetic resin sheet. The aforesaid bulletproof fiber sheet layer 10, the edge-proof and shock dispersing member 20, the soft rubber 30 and the bulletproof fiber sheet 40 are wholly integrally coated to form a material 60. This material 60 is mainly used to constitute accident protecting clothes.

Another embodiment of the present invention will be described hereinafter with reference to FIGS. 6 through 14. A reference numeral 1 designates a wedge in accordance with the present invention, which is integrally formed of a synthetic resin series material, comprising a ring-like base plate 1*a*, a plurality of horizontal pieces 1*b* radially extended from the base plate, and a wedge piece 1*c* formed at the end of each of these horizontal pieces. The base plate 1*a* is formed with one radial slit 1*d* provided with a slight spacing of 0.5 m/m.

The thus constructed wedge 1 is used by mounting and securing the wedge pieces 1*c* to the ends of engaging pieces 3*a*, 4*a* of two kinds of connectors 3, 4 to which connected are regular hexagonal tile-like small plate pieces 2. That is, the engaging pieces 3*a*, 4*a* of the connectors 3, 4 have their ends formed into an approximately truncated cone and diametral cuts 3*b*, 4*b* provided at the end surfaces thereof whereby when the engaging pieces are inserted into the holes 2*a* formed in the tile-like small plate piece 2, they are engaged at shoulders 2*b* of said holes. When the tile-like small plate pieces 2 are successively connected by the connectors 3, 4, a plate-like body 5 is formed. At this time, a slight spacing is maintained between the opposed sides of the tile-like small plate pieces adjacent to each other and the engaging pieces 3*a*, 4*a* of the connector 3, 4 are in a loosely fitted state with respect to the holes 2*a* of the tile-like small plate pieces, thereby providing a flexible construction so that they may be moved each other to some extent even after connection. Moreover, since the connectors 3, 4 are extended over the opposed sides of the tile-like small plate pieces 2, clearances between the tile-like small plate pieces are in the state wherein they are all blocked. In the reverse side of the tile-like small plate pieces 2, the end surfaces of the engaging pieces 3*a*, 4*a* of the connectors 3, 4 are exposed to the holes 2*a*, and the aforesaid cuts 3*b*, 4*b* are in the direction parallel to the sides of the tile-like small plate pieces 2. If the wedge pieces 1*c* formed in the ends of the wedge 1 are fitted in these cut holes 3*b*, 4*b*, the wedge 1 may be mounted on the tile-like small plate piece 2. Preferably, at this time, bonding should be made so that the wedge piece 1*c* may not be slipped out, and as shown in FIG. 14 illustrating a further embodiment, engaging projections 1*e*, 3*c* (4*c*) can be provided in the wedge piece 1*c* and cut holes 3*b* (4*b*) for positive engagement.

If the wedge 1 is fixed in the manner as described, the ends of the connectors 3, 4 will not be contracted after connection, and even if an external force is applied, the engaging pieces 3*a*, 4*b* of the connectors 3, 4 will not be slipped out of the holes 2*a* of the tile-like small plate pieces 2.

Since the ring-like base plate 1 is formed with a slit 1*d*, the wedge 1 can follow without difficulty when the flexible plate-like body 5 expands and contracts. Moreover, when the plate-like body 5 expands, a force is exerted in a fastening direction and when contracts, a force is exerted in an expanding direction, that is, returning to its original condition, by the resilient force generated in the ring-like base plate 1*a*, to impart an excellent characteristic to the plate-like body 5 as a material for accident protecting clothes.

The material for accident protecting clothes in accordance with the present invention are constructed as described above. Since the layer of bulletproof fiber sheet 10 having a noninflammability is present on the side close to the surface, the body is protected from fire. In addition, even if broken pieces of metal, glass and the like are flied due to explosions or the like, these broken pieces are stopped by the bulletproof fiber sheet layer 10 and are not directly pierced into the body, and the shocks thereof are relieved by the edge-proof and shock dispersing member 20 and soft rubber 30, thus sufficiently protecting the body. Furthermore, even if the bulletproof fiber sheet layer 10 is torn by sharp edged tools or the like, this can be prevented by the aforesaid edge-proof and shock dispersing member 20 to protect the body from a ruffian, a weapon and the like, of course providing a bulletproof effect. Moreover, the material of the present invention is light-weight and flexible and therefore there is no abnormal feeling even if it is worn. One can move freely and the material of the present invention is optimum for accident protecting clothes. The synthetic resin sheet on the surface has a water-proofing function whereby the strength of the bulletproof fiber is maintained and the sheet is durable against water, which is very convenient.

In addition, the present invention provides a material for accident protecting clothes having a construction which is strong against the external force in which the engaging pieces of the connectors are not slipped out of holes of the tile-like small plate pieces after connection since anti-slipout wedge pieces are inserted in and secured to the cut holes at the ends of the engaging pieces of the connectors to which tile-like small plate pieces are connected. Furthermore, the anti-slipout wedge in accordance with the present invention is provided with wedge pieces in coincidence with the number of the connecting portions (with the connectors) of the tile-like small plate pieces and the wedge pieces provided in coincidence with the direction of the cut holes of the connectors exposed to the connecting portions. Therefore, one wedge can be mounted on one tile-like small plate piece, and mounting thereof can be carried out very efficiently.

Moreover, the anti-slipout wedge in accordance with the present invention not only follows the expansion and contract of the plate-like body after mounting but has the action for restoring the change thereof, and therefore, it has the effect in enhancing the comfortableness to wear of the accident protecting clothes using the plate-like bodies as mterials.

As described above, the present invention can provide optimum materials for protecting clothes which can protect the body from fire, explosions, weapons and the like, and the range of use thereof is wide and practical values are very high.

What is claimed is:

1. A material for accident protecting clothes characterized in that tile-like small plate pieces made of nylon series resin are connected and formed, beneath a layer of bulletproof fiber sheets stacked in number as required, into a flexible plate-like configuration by connectors, soft rubber is placed beneath the flexible plate, a few sheets of bulletproof fiber sheets are attached beneath the soft rubber, and the whole structure is integrally coated wth a water-resisting synthetic resin sheet.

2. The material for accident protecting clothes according to claim 1 including an anti-slipout wedge comprising a ring-like base plate, a horizontal piece extended from said base plate and a wedge piece formed at the end of said horizontal piece.

* * * * *